United States Patent [19]

Altenbach, Jr.

[11] Patent Number: 5,035,400

[45] Date of Patent: Jul. 30, 1991

[54] STAPLE REMOVAL TOOL

[76] Inventor: Paul J. Altenbach, Jr., 106 Main St., Glendon, Easton, Pa. 18042

[21] Appl. No.: 483,147

[22] Filed: Feb. 21, 1990

[51] Int. Cl.[5] ..... B25C 11/00

[52] U.S. Cl. ..... 254/28; 29/270

[58] Field of Search ..... 254/21, 25, 28; 269/3; 29/270, 275

[56] References Cited

U.S. PATENT DOCUMENTS

| | | | |
|---|---|---|---|
| 406,538 | 7/1889 | Rickolson . | |
| 715,207 | 12/1902 | King . | |
| 910,173 | 1/1909 | Cochran . | |
| 957,924 | 5/1910 | Young . | |
| 1,802,687 | 12/1928 | Vrana | 254/28 |
| 2,250,848 | 7/1941 | Williams | 254/28 |
| 3,947,904 | 4/1976 | Hayes | 7/3 A |
| 4,730,386 | 3/1988 | Fieberg et al. | 269/3 |
| 4,926,537 | 5/1990 | Pool | 29/275 |

*Primary Examiner*—J. J. Hartman

*Attorney, Agent, or Firm*—Panitch, Schwarze, Jacobs & Nadel

[57] ABSTRACT

A tool for the removal of a staple employed for attachment of a cable to a support structure comprises a head member, including a pair of outwardly extending, generally parallel engagement members. The engagement members are spaced apart a distance which is less than the distance between the legs of the staple and which is greater than the lateral width of the cable. A handle member engages the head member in a manner such that the application of a force upon the handle member causes the engagement members to exert a force upon the crown of the staple to move the crown away from the support structure, thereby removing the legs of the staple from the support structure.

4 Claims, 1 Drawing Sheet

STAPLE REMOVAL TOOL

BACKGROUND OF THE INVENTION

The present invention relates generally to tools and, more particularly, to a tool for the removal of a staple employed for attachment of a cable, such as an electrical cable to a support structure.

Electrical cables, particularly cables used for the conducting of electrical current, such as house current, are generally required by building and/or other codes or specifications, to be firmly secured to a relatively stable support structure. Typically, in the case of electrical wiring used in the construction industry, current conducting cables are secured to wall studs, rafters, etc. utilizing one or more wire staples. Wire staples of this type, commonly referred to as "Romex" wire staples are sold in various sizes, depending upon the size of the electrical cable to be secured. Typically, each staple includes a pair of generally parallel legs which are interconnected on one end by a crown to form a generally U-shaped staple. The size of the staple to be used is selected so that the distance between the legs of the staple generally corresponds to or is at least slightly greater than the lateral width of the cable being secured. The staple is installed by placing one leg of the staple on either lateral side of the cable and then driving the staple legs into the stud or other support structure, with the crown of the staple spanning the wire. The legs are driven far enough into the support structure so that the cable is held securely in place with the crown of the staple either spaced slightly away from the cable or directly engaging the cable. Preferably, neither the crown nor the legs of the staple pierce, pinch or otherwise detrimentally affect the cable. When a staple of this type is properly installed, it will hold an electrical cable in place for substantially the entire length of the expected life of a building.

It sometimes is desirable to reposition or remove an electrical cable which has been secured to a support structure utilizing such staples. While it is possible to remove staples of this type utilizing traditional tools, such as a claw-type hammer, pliers, screw driver, etc., because of the nature of such staples, removal utilizing such prior art tools is cumbersome, at best. In addition, when utilizing existing tools, there is a likelihood that the removal of a staple will result in the application of undesirable forces to the electrical cable, possibly damaging, or even severing, the cable. The present invention overcomes the problems associated with the existing tools by providing a staple removal tool for fast, efficient removal of such staples without damaging or otherwise detrimentally affecting the cable secured by the staple.

SUMMARY OF THE INVENTION

Briefly stated, the present invention comprises a tool for the removal of a staple employed for the attachment of a cable to a support structure without damaging the cable. The tool includes a head member having a pair of outwardly extending, generally parallel engagement members spaced apart a distance which is less than the distance between the legs of the staple and which is greater than the lateral width of the cable. The engagement members are employed for engaging the crown of the staple between the legs and between the crown and the support structure. A handle member engages the head member in a manner such that the application of a force upon the handle member causes the engagement members to exert a force upon the crown of the staple to move the crown away from the support structure and to remove the legs of the staple from the support structure.

BRIEF DESCRIPTION OF THE DRAWING

The foregoing summary, as well as the following detailed description, will be better understood when read in conjunction with the appended drawing. For the purpose of illustrating the invention, there is shown in the drawing an embodiment which is presently preferred, it being understood, however, that this invention is not limited to the precise arrangement and instrumentalities shown. In the drawing.

DESCRIPTION OF THE PREFERRED EMBODIMENT

Figure 1:
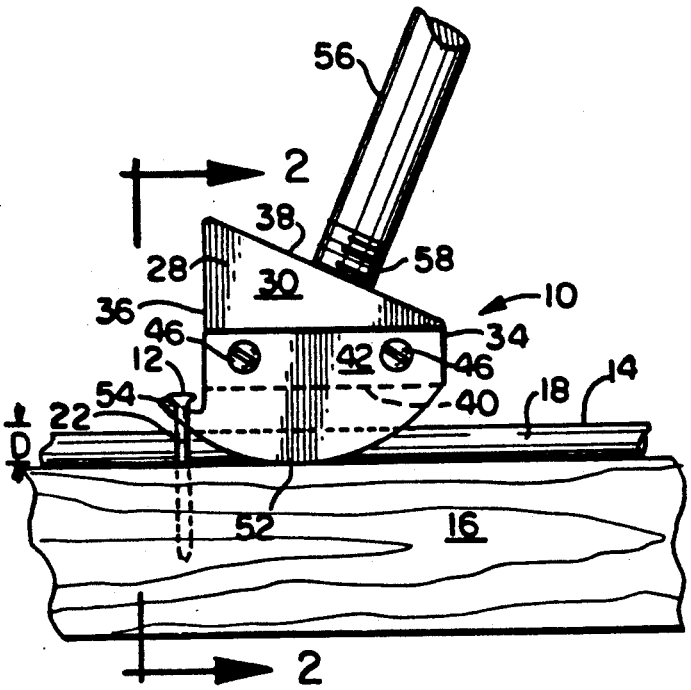
FIG. 1 is a side elevational view of a preferred embodiment of a staple removal tool in accordance with the present invention.

Referring to the drawing, in which like numerals indicate like elements throughout, there is shown in FIG. 1 a staple removal tool generally 10. The staple removal tool 10 is employed for the removal of a staple 12 which is used for the attachment of a cable 14 to a support structure 16. The cable 14, as illustrated in the drawing, is a "Romex" electrical cable of a type which is typically employed for conducting electrical energy throughout a house, building, or other facility. Cables of this type typically include a pair of electrically conducting primary wires, typically colored white and black (not shown), and, in most cases, a ground wire, typically covered with green insulation, or uninsulated (not shown). The cable 14 has a width (W) and a thickness or depth (D) which varies from cable to cable, depending upon the size of the cable and the particular application. Cable 14 also includes generally parallel, lateral sides 18 and 20.

It should be appreciated by those skilled in the art that while a "Romex" type cable 14 is shown in the drawings and will be hereinafter discussed in the specification, use of the present invention is not limited to a cable of this type. The present invention is equally usable in connection with the removal of a staple 12 from any other type of cable, wire, etc. (not shown).

As discussed above, the support structure 16 typically comprises a wooden wall stud, rafter, wall or other relatively fixed structure which is employed for supporting the cable 14. It should also be appreciated by those skilled in the art that the present invention is not limited for use in conjunction with any particular type of support structure but may be employed for the removal of a staple from any support structure.

The staple 12 illustrated in the drawing is of a type well known in the art and typically referred to as a "Romex" staple. The staple 12 includes a pair of generally parallel legs 22 and 24 which are spaced apart a predetermined distance. The spacing between the staple legs 22 and 24 will vary, depending upon the size of the staple. Typically, staples of this type are available in a range of sizes, including ½ inch and ¾ inch sizes. Preferably, the size of the staple 12 is determined by the size of the cable 14 to be secured by the staple. Thus, the predetermined spacing between the staple legs 22 and 24 is preferably at least as great as the lateral width (W) of the cable 14. In this manner, the staple 14 can be installed without piercing or otherwise damaging the cable 14.

Figure 2:
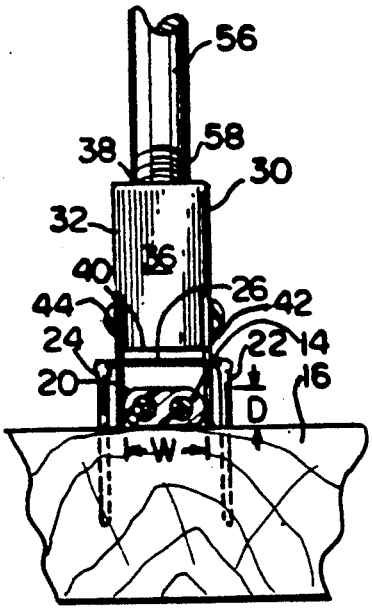
FIG. 2 is a front elevational view, partially in section, taken along line 2—2 of FIG. 1.
Figure 3:
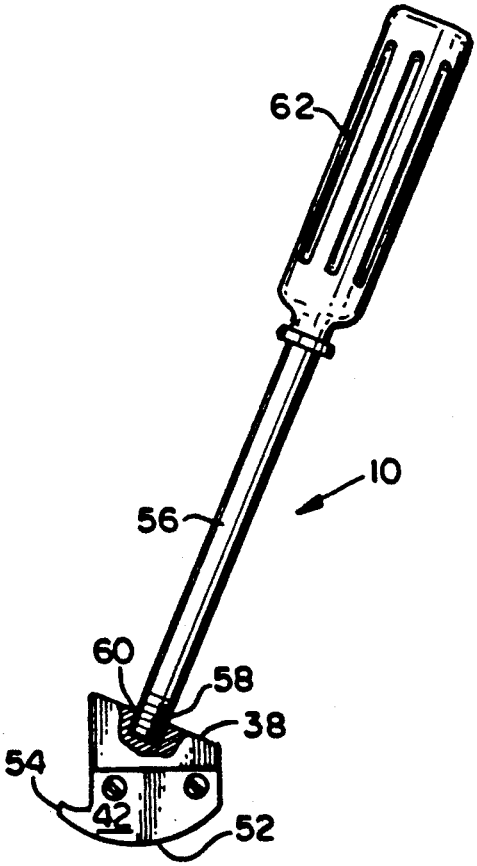
FIG. 3 is a reduced size elevational view of the tool of FIG. 1 illustrating the handle.

A first end of each of the staple legs 22 and 24 are interconnected by a crown 26. When the staple is installed in the support structure 16, as shown in FIGS. 1 and 2, the crown 26 spans the cable 14 to secure the cable to the support structure 16. The other ends (not shown) of the staple legs 22 and 24 are preferably tapered or beveled to facilitate installation of the staple legs 22 and 24 into the support structure 16 as shown. As discussed above, preferably the staple 12 is installed with the legs 22 and 24 extending into the support structure 16 so that the crown 26 is spaced slightly away from the cable 14 or is in engagement with the cable 14 in a manner such that the crown does not pierce, crimp or otherwise detrimentally affect the cable 14, yet adequately secures the cable 14 to the support structure 16.

In the presently preferred embodiment, the staple removal tool 10 includes a head member 28 which preferably is formed of a high strength material, such as steel or tool steel. The head member 28 is generally block-like and includes a pair of generally parallel lateral side surfaces 30 and 32, generally parallel first and second end surfaces 34 and 36, a top surface 38, and a bottom surface 40. As best shown in FIG. 1, the top surface 38 is not parallel with the bottom surface 40 but, instead, extends at an angle for purposes which will hereinafter become apparent. In the presently preferred embodiment, the angle is approximately 23°, although it will be appreciated by those skilled in the art that the angle may vary. Because of the angled position of the top surface 38, the side surfaces 30 and 32 are generally trapezoid shaped and the end surfaces 34 and 36, although generally rectangular in shape, are of differing sizes. It will be appreciated by those skilled in the art that while the shape of the preferred embodiment of the head member 28 is as shown and described, it could be of some other shape without departing from the scope of the present invention.

A pair of generally parallel engagement members 42 and 44 are removably secured to the lateral side surfaces 30 and 32 of the head member 28. In the embodiment shown, a small shoulder is provided on the bottom end of each of the side surfaces 30 and 32 for receiving the engagement members 42 and 44. In the presently preferred embodiment, each of the engagement members 42 and 44 comprises a generally flat plate which is secured to the head member side surfaces 30 and 32 utilizing a pair of threaded fasteners which extend through suitably sized openings in the engagement members 42 and 44 and into complementary threaded openings within the side surfaces 30 and 32. In the presently preferred embodiment, the threaded fasteners are illustrated as being screws 46. However, it will be appreciated by those skilled in the art that other types of threaded fasteners, such as bolts, Allen screws, etc could alternatively be employed. It will also be appreciated that some other type of fastening means, such as gluing, welding, press fitting, etc., could alternatively be employed for securing the engagement members 42 and 44 to the side surfaces 30 and 32 of the head member 28. In addition, it will be appreciated that the engagement members 42 and 44 may be secured to the head member 28 without the use of the small shoulders.

As best shown in FIG. 1, the engagement members 42 and 44 each include a generally curved bottom portion 52 and a generally tapered or pointed portion 54. Preferably, the engagement members 42 and 44 are made of a relatively hard material, such as hardened tool steel, in order to minimize wear or breakage, particularly of the pointed portion 54. The curved portion 52 of the engagement members 42 and 44 extends beyond the bottom surface 40 of the head member 28 for purposes which will hereinafter become apparent. Likewise, the pointed portion 54 extends outwardly beyond the end surface 36 of the head member 28, again, for purposes which will hereinafter become apparent.

As best shown in FIG. 2, the engagement members 42 and 44, when secured to the head member 28, are generally parallel to each other and are spaced apart a distance which is at least slightly less than the distance between the legs 22 and 24 of the staple 12. Preferably, the spacing of the engagement members 42 and 44 is precisely established so that the pointed portions 54 engage the staple crown 26 adjacent to the legs 22 and 24 as illustrated in FIG. 2. Because of the spatial relationship between the engagement members 42 and 44 with respect to the staple legs 22 and 24, the pointed portions 54 may be easily inserted between the staple legs 22 and 24 and into firm engagement with the crown 26 without the need to apply an insertion force. Correspondingly, the distance between the engagement members 42 and 44 is greater than the lateral width (W) of the cable 14. In this manner, the engagement members 42 and 44, particularly the pointed portion 54 thereof, may engage the crown 26 of the staple 12 between the staple legs 22 and 24 without engaging, crimping or otherwise detrimentally affecting the cable 14 (see FIG. 2). Likewise, the curved portion of the engagement members 42 and 44 could roll over any other cables (not shown) or other components located proximate to the staple 12 without damaging such cables or components. As will be appreciated by those skilled in the art, the spacing of the engagement members 42 and 44 may vary depending upon the size of the staple 12 and/or the size of the cable 14. For example, if the staple is wider than the staple 12 shown in the drawings, the engagement members 42 and 44 could be spaced further apart, either by providing a wider head member 28 or by providing thicker engagement members 42 and 44. On the other hand, if the staple was smaller than that shown in the drawing, the spacing between the engagement members 42 and 44 would be decreased by providing a narrower head member 28. It should also be appreciated by those skilled in the art that the head member 28 and engagement members 42 and 44 could comprise a monolithic structure rather than the three-part structure shown in the drawing.

A handle member 56 is removably secured to the head member 28. In the presently preferred embodiment, the handle member or handle 56 includes a first threaded end 58 which is adapted to be received within a suitably sized, complementary threaded opening 60 within the top surface 38 of the head member 28. It will be appreciated by those skilled in the art that the handle 56 could be removably secured to the head member 28 utilizing some other form of mechanical interconnection (not shown) or could be permanently secured to the head member.

In the present embodiment, the handle 56 extends from the head member 28 at an angle of about 22°. It will be appreciated that the handle 56 could extend from the head member 28 at any other desired angle. It will also be appreciated that the handle 56 could be secured to the head member 28 utilizing a knuckle, ratchet or any other type of mechanical attachment device (not shown) to permit use of the tool 10 in a restricted space or other difficult work environment.

The second end 62 of the handle 56 is suitably sized and shaped for convenient gripping by a user. Preferably, gripping means in the form of knurling, ridges, etc. is provided to facilitate gripping and holding of the handle 56.

In using the staple removal tool 10, the tool is positioned as shown in FIGS. 1 and 2 so that the pointed portion 54 of the engagement members 42 and 44 may be easily inserted between the staple crown 26 and the support structure 16 without the use of an insertion force. As discussed above, the engagement members 42 and 44 are suitably spaced apart so that the pointed portion 54 of each engagement member can be easily inserted between the staple legs 22 and 24 without engaging the cable 14 (see FIG. 2). The handle 56 is then moved away from the staple 12 (toward the right when viewing FIG. 1) in a manner so that the curved portion 52 of each of the engagement members 42 and 44 rotates upon the support structure 16, thereby causing the pointed portion 54 of the engagement members to move away from the support structure 16 (upwardly when viewing FIG. 1). Movement of the pointed portion 54 of the engagement members 42 and 44 away from the support structure results in a force being exerted upon the crown 26 of the staple to move the crown 26 away from the support structure 16 (upwardly when viewing FIGS. 1 and 2) and to thereby remove the staple legs 22 and 24 from the support structure 16. Continued movement of the handle 56 results in the staple 12 being completely removed from the support structure 16, thereby permitting the cable 14 to be freely moved, as desired, and permitting reuse of the staple 12.

From the foregoing description of a presently preferred embodiment, it can be seen that the present invention comprises a tool for the removal of a staple. It will be appreciated by those skilled in the art that changes could be made to the embodiment described without departing from the inventive concepts thereof. It is understood, therefore, that this invention is not limited to the particular embodiment disclosed, but it is intended to cover all modifications which are within the scope and spirit of the invention as defined by the appended claims.

I claim:

1. A tool for the removal of a staple employed for attachment of a cable to a support structure without damaging the cable, the staple including a pair of generally parallel spaced legs extending at least partially into the support structure on both lateral sides of the cable, the legs being interconnected by a crown which spans the cable and secures the cable to the support structure, the tool comprising:

a head member having generally parallel spaced lateral sides and including a pair of outwardly extending, generally parallel flat plates spaced apart a distance which is less than the distance between the legs of the staple and which is greater than the lateral width of the cable, each of the flat plates being secured to a lateral side of the head member such that the plane of each plate is generally parallel to the plane of the lateral side to which it is secured, a workpiece engaging surface being located on each plate perpendicular to the plane of each plate for engaging the crown of the staple between the legs and between the crown and the support structure, the plates include a support structure engaging surface which is generally curved; and a handle member for engaging the head member in a manner such that the application of a force upon the handle member causes the flat plates to exert a force upon the crown of the staple to move the crown away from the support structure and to remove the legs of the staple from the support structure.

2. The tool as recited in claim 1 wherein the plates are tapered so that their ends, distal from the head member are pointed.

3. The tool as recited in claim 1 wherein the plates are secured to the lateral sides of the head member utilizing a pair of threaded fasteners.

4. The tool as recited in claim 1 wherein the plates are formed of hardened tool steel.

* * * * *